US005210348A

United States Patent [19]

Hsieh et al.

[11] Patent Number: 5,210,348

[45] Date of Patent: May 11, 1993

[54] PROCESS TO REMOVE BENZENE FROM REFINERY STREAMS

[75] Inventors: C. Richard Hsieh; Richard C. Robinson, both of San Rafael, Calif.

[73] Assignee: Chevron Research and Technology Company, San Francisco, Calif.

[21] Appl. No.: 704,367

[22] Filed: May 23, 1991

[51] Int. Cl.[5] ..... C07C 5/22; C07C 5/10; C07C 2/64; C07C 7/00

[52] U.S. Cl. ..... 585/253; 585/254; 585/269; 585/277; 585/323; 585/446; 585/447; 585/467; 585/800; 208/62; 208/66; 208/133; 208/138; 208/143

[58] Field of Search ..... 585/253, 254, 269, 277, 585/323, 446, 447, 467, 800; 208/62, 66, 133, 138, 143

[56] References Cited

U.S. PATENT DOCUMENTS

| | | | |
|---|---|---|---|
| 4,950,387 | 8/1990 | Harandi et al. | 208/49 |
| 4,950,823 | 8/1990 | Harandi et al. | 585/323 |
| 4,975,179 | 12/1990 | Harandi et al. | 585/323 |
| 4,997,543 | 3/1991 | Harandi et al. | 208/49 |
| 5,003,118 | 3/1991 | Low et al. | 585/253 |

*Primary Examiner*—Helen M. S. Sneed

*Assistant Examiner*—Nhat D. Phan

*Attorney, Agent, or Firm*—W. Keith Turner; Robert D. Touslee

[57] ABSTRACT

A substantially benzene-free product suitable for gasoline blending is formed from a benzene-containing refinery stream. At least about 30% of the benzene initially present in the stream is catalytically alkylated with $C_2$–$C_4$ olefins to form alkylated products. Most preferably, the alkylation zone is present in the distillation column and the alkylated products drop to the lower portion of the column and are recovered with the heavy fraction. Alternatively, the alkylation zone is downstream of the distillation column and a secondary distillation column removes the heavier alkylated products. The remaining light fraction is hydrogenated to convert substantially all of the remaining non-alkylated benzene to cyclohexane and is isomerized to boost the octane of $C_5$–$C_7$ paraffins, preferably in a single reactor. The combined light and heavy fractions, which contain the debenzenated and isomerized product and the alkylated benzene, can be combined to provide a substantially benzene-free gasoline blending stock, It is produced without deleterious effect on octane numbers and with increased volume as compared to the original refinery stream.

67 Claims, 4 Drawing Sheets

PROCESS TO REMOVE BENZENE FROM REFINERY STREAMS

TECHNICAL FIELD

The present invention relates to a process for removing benzene from refinery streams with substantially no loss in octane numbers (research octane number (RON) and motor octane number (MON)) and with an increase in volume.

BACKGROUND OF THE INVENTION

The requirement that lead by phased out and the introduction of premium unleaded gasoline has created a strong demand for increased gasoline octane numbers. Conventional approaches such as increasing operating severity in reformers and fluid catalytic cracking units, or using octane catalysts and additives in fluid catalytic cracking units result in losses of gasoline yields. In addition, these approaches often increase the fuel gas yields in a refinery which may sometimes cause a reduction in refinery throughput and profitability.

Typical gasoline contains 2 to 5 liquid volume percent benzene, a chemical which has a high octane blending value, but is considered hazardous to human health and environment. The State of California, for example, has included benzene on its toxic chemical list, and the State of California Air Resources Board and the United States Environmental Protection Agency are considering regulations to limit the amount of benzene which may be present in gasoline to a level much lower than what is found in current gasoline. It is therefore highly desirable to remove benzene from gasoline. However, physically separating benzene from gasoline by distillation or extraction has the undesirable effect of decreasing both the octane rating and the volume of gasoline.

As an alternative, benzene and gasoline may be hydrogenated to a non-aromatic compound. This approach is also undesirable, because it requires a relatively high pressure operation and consumes hydrogen which is usually expensive in a refinery. Hydrogenation of benzene also reduces the octane rating of the gasoline.

To overcome these disadvantages, it has been found that benzene may be alkylated with resulting actual improvements in both octane and volume of gasoline produced. Co-pending U.S. Patent application Ser. No. 64,121, filed Oct. 28, 1988, discloses reacting a refinery stream with an olefin-containing stream in a distillation column reactor in the presence of an alkylation catalyst to thereby alkylate light aromatics, particularly benzene.

The chemical reactions involving alkylation of aromatics with olefins have been studied for a long time. For example, U.S. Pat. No. 2,860,173 discloses the use of a solid phosphoric acid (SPA) as a catalyst for the alkylation of benzene with propylene to produce cumene. U.S. Pat. No. 4,347,393 discloses the use of Freidel Crafts catalyst, especially aluminum chloride, for this reaction. More recently, certain rare earth modified zeolites and Mobil's HZSM-5 zeolite catalyst have been used to carry out this reaction. Examples may be found in the *Journal Of Catalysis* Volume 109, pages 212–216 (1988).

The alkylation of benzene with ethylene to produce ethylbenzene is a known commercial process. The Mobil/Badger ethylbenzene process produces high purity ethylbenzene in vapor phase with a multiple-bed reactor and a series of distillation columns. A description of the process using a dilute ethylene stream may be found in the *Oil and Gas Journal*, Volume 7, pages 58–61 (1977).

It is important to distinguish that while catalytic aromatic alkylation is known, it is subject to the unexpected and unpredictable vagaries of catalytic processes. For example, in U.S. Pat. No. 3,527,823 (Jones) there is disclosed the reaction of benzene and propylene over phosphoric acid catalyst in a fixed bed upflow reactor to produce cumene. While the benzenepropylene reaction was successful, the Jones process was not applicable to the reaction of benzene and ethylene (column 13, line 36). Poor yields of ethyl benzene were obtained by Jones. However, increased ethylene purity increased the conversion of ethylene (column 13, line 10) although the yield of ethyl benzene was still not satisfactory. In another U.S. Pat. No. 3,437,705, Jones discloses the alkylation of an aromatic compound with an olefin in an aromatic to olefin mol ratio of from 2:1 to 30:1. The process is characterized by the presence of an unreacted vapor diluent, such as propane, in the reaction zone. The total alkylation effluent is passed to a flash distillation zone where the unreacted diluent is separated. The process is purportedly applicable to a variety of reactions using feedstocks containing unreactive vapor diluents.

The concept of catalytic distillation, to the extent chemical reactions and distillation are carried out in the same vessel, is known. U.S. Pat. No. 3,629,478 discloses a method for separating linear olefins from tertiary olefins by feeding a mixture of alcohol, tertiary pentenes and linear pentenes to a distillation column reactor, atalytically reacting the tertiary pentenes with the alcohol by contacting them with heterogeneous atalyst located above the feed zone, and fractionating the ether from the linear pentene in the distillation column reactor. U.S. Pat. Nos. 3,634,534 and 3,634,535 disclose a method for separating a first chemical from a mixture of chemicals using two distillation column reactors in series. In the first distillation column reactor, the first chemical undergoes a reaction to form a second chemical which is easily fractionated from the mixture of chemicals. This second chemical is then fed to the second distillation column reactor, where the reaction is reversed and the first chemical is recovered by fractionation.

U.S. Pat. Nos. 4,232,177 and 4,307,254 disclose a method for conducting chemical reactions and fractionation of a reaction mixture comprising feeding reactants to a distillation column reactor into a feed zone and concurrently contacting the reactants with a fixed bed catalytic packing to carry out both the reaction and fractionate the reaction mixture. One example is the preparation of methyl tertiary butyl ether (MTBE) in high purity from a mixed feed stream of isobutene and ion exchange resin. U.S. Pat. No. 4,242,530 discloses a method for the separation of isobutene from a mixture comprising n-butene and isobutene by feeding a $C_4$ stream to a distillation column reactor and contacting the stream with fixed bed acidic cation exchange resin to form diisobutene which passes to the bottom of the column, the n-butene being removed overhead. U.S. Pat. No. 4,624,748 discloses a novel catalyst system for use in a distillation column reactor which includes angularly-defined spaces within the reactor.

U.S. Pat. No. 4,849,569 (Smith) discloses a process for alkylating aromatic compounds by contacting the aromatic compound with a $C_2$ to a $C_{20}$ olefin in a distillation column reactor containing a fixed bed acidic catalyst comprising molecular sieves and cation exchange resins. The mol ratio of aromatic compounds to olefin is in the range of 2-100:1, since the greater the excess of aromatic compound the more selectivity is given to the desired product.

In spite of the art discussed, catalytic distillation reaction processes are not conventionally applied to complex hydrocarbon feedstocks and catalytic reactions thereof. It is important to distinguish that while such U.S. Pat. Nos. as 3,629,478 (Haunschild), 4,849,569 (Smith) and 4,471,154 (Franklin) disclosed the use of distillation reactors, these patents do not suggest the use of complex refinery streams as feedstocks for such distillation reaction processes. Refinery streams are complex when they contain many different chemical components in a boiling range. Conventional distillation reaction processes are limited to reactive feed streams each of which is relatively pure, in the sense that each is composed of chemical constituents having some physical and/or chemical similarity.

A paper entitled "Alkylation of FCC Off Gas Olefins with Aromatics Via Catalytic Distillation", I. E. Partin was presented at the National Petroleum Refineries Association Meeting, Mar. 22, 1988. This paper discloses a catalytic distillation process which alkylates the refiners light olefin gases such as ethylene and propylene, present in FCC and coker unit tail gas with light aromatics such as benzene and toluene, present in reformate to produce alkylated aromatics.

In the process as taught in this paper full range reformate is charged to the lower distillation section and the total FCC off gas stream charged beneath the catalyst section. The solid proprietary catalyst is secured within supports which form bundles for installation in the distillation tower. As olefins and aromatics proceed into the catalyst section and react, the heavier alkylated aromatics drop out into the lower fractionation zone and out the bottom of the tower with the heavy portion of the reformate. Light components, including light gases, proceed through the reactor and are stripped through the upper distillation section. Part of the unreacted benzene is recycled back to the tower to increase benzene conversion. Non-condensible gases go to fuel gas and light liquid is circulated back to the refinery gas plants or sent to gasoline blending.

The present process is applicable to the product streams from a number of refining processes, including fluid catalytic cracking (FCC), coking, and catalytic reforming, among others. Fluidized catalytic cracking (FCC) of heavy petroleum fractions is one of the major refining methods to convert crude or partially-refined petroleum oil to useful products, such as fuels for internal combustion engines and heating oils. A principal product of the FCC process is FCC gasoline, i.e., a liquid fraction boiling in the gasoline-range. FCC gasoline can contain a minor amount of benzene and other aromatics. The products may also include a mixture of hydrocarbon gases ranging from hydrogen, methane, ethylene, ethane, propylene, propane, to butylene, isobutane, butane, and heavier hydrocarbon gases. Various fractions of the gases are recovered in a vapor recovery unit.

While the details of a vapor recovery unit may vary, a typical arrangement involves first feeding the reactor effluent into a main fractionator. The fractionator overhead is compressed and fed into a de-ethanizer where the $C_2$ and lighter gas entrained with some $C_3$'s and $C_4$'s is separated as an overhead product and fed into a sponge absorber. A lean sponge oil, typically a slip stream of heavy gasoline or light cycle oil, is used in the absorber to recover as much as possible the $C_3$+ components in the de-ethanizer overhead. The rich sponge oil is usually returned to the main fractionator. Although it may still contain some $C_3$+ components, the absorber overhead is usually called off-gas and is used as refinery fuel after some treating for sulfur removal. The de-ethanizer bottoms are fed into a de-propanizer where most of the propane/propylene gas is recovered as overhead.

Coking is a method to minimize refinery yields of residual fuel oil by severe thermal cracking of stocks such as vacuum residuals and thermal tars. It has been used to prepare coker gas oil streams suitable for feed to a catalytic cracker, to prepare hydrocracker feedstocks, to produce a high quality "needle coke" from stocks such as catalytic cracker heavy cycle oil, and to generate low BTU refinery fuel gas. Similar to atalytic cracking, coking produces a range of gas and liquid products which are separated in a distillation section. The lightest fraction which goes through a sponge oil absorber is usually called tail gas or off-gas and is used as refinery fuel gas.

Catalytic reforming is a method to convert low octane gasoline and naphtha streams into higher octane gasoline blending stock. The process typically increases the aromatic contents from 5%-10% in feed to 45%-60% in the liquid product, which is called "reformate". The benzene content makes up only from 2% to 10% of the reformate and is therefore a minor component of the reformate. The liquid products from a catalytic reformer are typically debutanized in a debutanizer which is sometimes called a stabilizer. The reformate is either sent directly to storage, or further separated to light reformate and heavy reformate. In some refineries, light aromatics such as benzene, toluene, and xylene are recovered as chemicals.

It would be advantageous if the minor amount of benzene in FCC gasoline and reformate could be alkylated to the maximum extent by the appropriate selection of reaction process and catalyst, using available olefin-containing refinery feedstocks.

The present invention overcomes the disadvantages of the prior art in that alkylation of benzene is carried out without loss of octane number or of volume of gasoline. Indeed, volume is somewhat increased. In accordance with a preferred embodiment of the present invention the alkylation portion of the process is carried out in a distillation reactor column. Preferably, the hydrogenation and isomerization portions of the process are also carried out in the distillation reactor column.

DISCLOSURE OF INVENTION

The present invention relates to a process for producing a debenzenated and isomerized product useful as a gasoline blending stock from a benzene-containing refinery stream. The process comprises reacting the benzene-containing refinery stream in an alkylation zone with a $C_2$-$C_4$ olefin-containing stream in the presence of an alkylation catalyst under alkylation conditions selected to alkylate at least about 30% of the benzene initially present in the refinery stream to form an alkylated stream containing both alkylated and non-alkylated benzene. The alkylated refinery stream is separated into a substantially benzene-free heavier fraction and a benzene-containing lighter fraction. The benzene-containing lighter fraction is reacted with hydrogen in a hydrogenation zone in the presence of a hydrogenation catalyst under hydrogenation conditions selected to hydrogenate substantially all of the benzene to form a debenzenated product and is reacted in an isomerization zone with an isomerization catalyst under isomerization conditions to produce the debenzenated and isomerized product, the sum of the quantities of the debenzenated and isomerized product and the substantially benzene-free heavier fraction being at least equal to those of the refinery stream.

The present invention relates to a process for producing a debenzenated and isomerized product useful as a gasoline blending stock from a benzene-containing refinery stream, for example, a reformate stream. The refinery stream is fed into a distillation column in which it is separated into a benzene-containing light fraction and a substantially benzene-free heavy fraction. The light fraction is reacted in an alkylation zone with a $C_2$–$C_4$ olefin-containing stream in the presence of an alkylation catalyst under alkylation conditions selected to alkylate at least about 30% of the benzene initially present in the light fraction to form alkylated products. In a preferred embodiment of the invention the alkylation zone is present in the distillation column (which is then a distillation reactor column) and the alkylated products drop to the lower portion of the column and are recovered with the heavy fraction. In an alternative embodiment of the invention the alkylation zone is downstream of the distillation column and a secondary distillation column is added to remove the heavy alkylated products from the originally light fraction separated by the primary distillation column. In the second step of this process, the light fraction, substantially free of alkylated benzene products, is hydrogenated under hydrogenation conditions selected to hydrogenate substantially all of the remaining (non-alkylated) benzene to form a debenzenated product. The light fraction is also contacted in an isomerization zone with an isomerization catalyst under isomerization conditions to produce an isomerized product. In another embodiment of the invention the hydrogenation and isomerization reactions are carried out in multiple zones in a single reactor. The combined light and heavy fractions each comprise gasoline blending stocks. They can be combined, in which case the combination contains the debenzenated product, the isomerized product and alkylated benzene, and comprises a substantially benzene-free gasoline blending stock. The stock is produced without significant loss of octane as compared with the original refinery stream. Other streams containing $C_5$–$C_7$ paraffins can be added to the light fraction prior to or during isomerization to raise the octane numbers of the product gasoline blending stock.

Alkylation of a light reformate fraction with a $C_2$–$C_4$ olefin-containing stream leads to a conversion of a portion of the benzene to alkylated benzene but, unfortunately, does not lead to a complete conversion to alkylated benzene. Thus, there is remaining benzene (non-alkylated) after the alkylation process is completed. The alkylated stream is separated into a heavier benzene-free fraction and a lighter benzene containing fraction. Hydrogenation of the lighter fraction is then carried forth to substantially eliminate the benzene. The hydrogenation step leads to an increase in volume but it decreases the octane numbers. Isomerization of the paraffins is carried out to increase the octane numbers (RON and MON) of the final debenzenated and hydrogenated product. As a result, the final product has increased volume and octane numbers. In another embodiment of the invention, the isomerization and the hydrogenation are carried out together in multiple zones within a single reactor. Either different catalysts can be used for hydrogenation and isomerization or a dual function catalyst can be used to carry out both reactions. What results is an efficient process for eliminating all or substantially all benzene from gasoline with no loss in volume and no loss in octane numbers. In fact, modest gains in volume and octane numbers can also be realized.

BRIEF DESCRIPTION OF THE DRAWINGS

The invention will be better understood by reference to the figures of the drawings wherein like numbers denote like parts throughout and wherein.

DETAILED DESCRIPTION OF THE INVENTION

Figure 1:
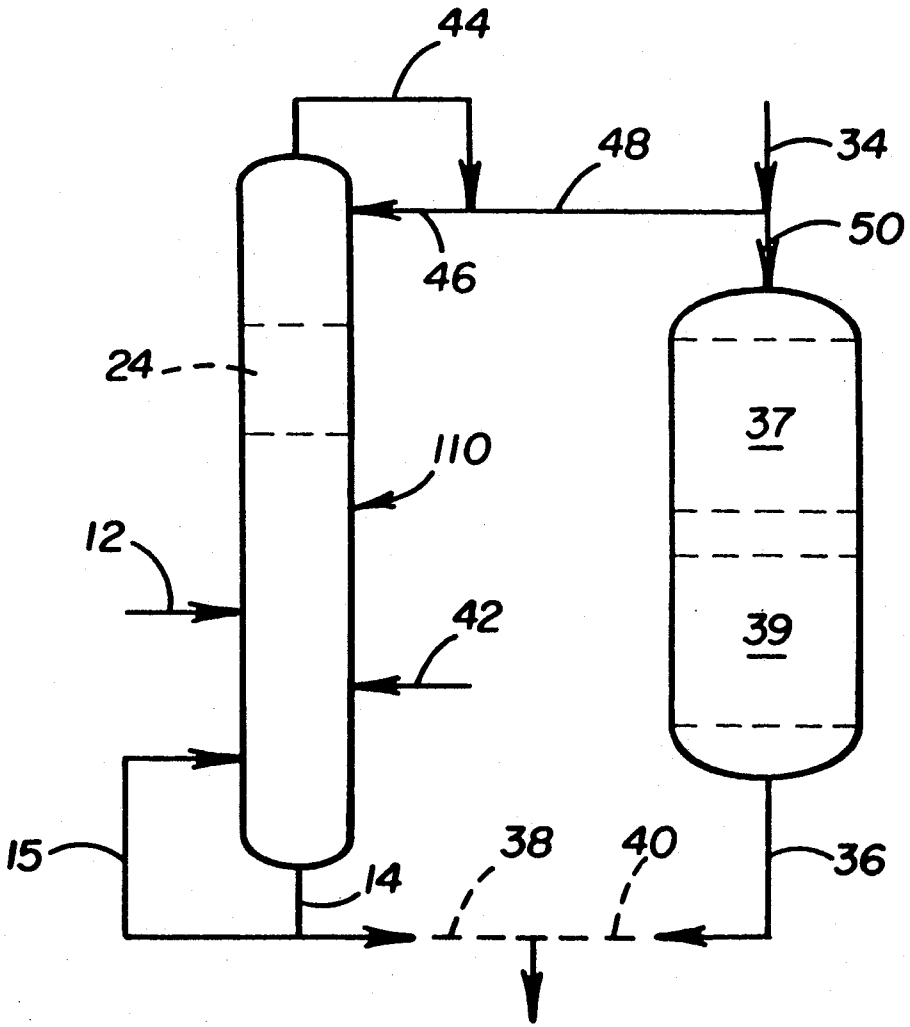
FIG. 1 is a schematic representation of an embodiment in accordance with the present invention.

The present invention provides a process for producing a substantially benzene-free product for gasoline blending from a benzene-containing refinery stream. The refinery stream is fed into a distillation column wherein it is separated into a benzene-containing light fraction and a substantially benzene-free heavy fraction. The light fraction is alkylated in an alkylation zone with gas containing $C_2$–$C_4$ olefins, more preferably with $C_2$–$C_3$ olefins (the terms $C_2$–$C_4$ and $C_2$–$C_3$ indicate that any one or more of $C_2$ and $C_3$ or, in the case of $C_2$–$C_4$, any one or more of $C_2$, $C_3$ and $C_4$, olefins are present). This is carried out in the presence of an alkylation catalyst under alkylation conditions which are selected to alkylate at least about 30% of the benzene initially present in the fraction.

The alkylation conditions will generally include a temperature which falls within a range from about 300° F. to about 500° F., preferably from about 350° F. to about 450° F., a pressure which falls within a range from about 100 psig to about 500 psig, preferably from about 150 psig to about 300 and a LHSV (liquid hourly space velocity), based on total liquid feed rate and catalyst volumes, which falls within a range from about 0.5 to about 5, preferably from about 1 to about 3.

COMPLEX REFINERY STREAMS

Any complex refinery streams containing a minor amount of benzene and which needs to be and can be reduced in benzene content by alkylation, is appropriate for use in the present process. By "complex refinery streams", it is intended to mean the normally liquid product streams found in a refinery from cokers, FCC units, reformers, hydrocrackers, hydrotreaters, delayed cokers, distillation columns, etc. which streams comprise a range of chemical constituents, mainly hydrocarbonaceous, and having a broad boiling point range. The preferred complex refinery stream is selected from the group consisting of reformate, light reformate, heart-cut reformate, FCC gasoline, FCC light gasoline, coker gasoline, and coker light gasoline. In accordance with some embodiments of the invention a light reformate is most preferred and comprises a complex aromatics-containing stream containing a minor amount of benzene, produced in a refinery reforming unit, and generally having a boiling point range of 60° to 220° F. In such instances the preferred benzene concentration of the light aromatics-containing streams is between about 1% and 40% by volume, more preferably between about 2% and 30% and most preferable between about 5% and 25%. In other embodiments of the invention a full boiling range reformate is the preferred feed. In such instances the reformate will generally have a boiling point range of 60° to 400° F. and the preferred benzene concentration of the full boiling range aromatics-containing stream is between about 1% and 20% by volume, more preferably between about 2% and 15% and most preferable between about 3% and 10%.

Any olefin-containing stream, preferably refinery-produced, is appropriate for use in this process. The preferred olefin-containing stream or streams are themselves complex refinery streams although normally gaseous. They are selected from the group consisting of FCC de-ethanizer overhead, FCC absorber overhead, sweetened FCC off-gas and sweetened coker off-gas. The major portion of the olefins in these streams ordinarily comprises ethylene and propylene. The concentration of olefins in these olefin-containing streams may vary, but is preferably between about 5% to 40% olefin by volume, and more preferably between about 10% and 30% by volume. Because this group of refinery streams is typically used as refinery fuel, it provides a cheap source of olefins. In another embodiment, the preferred streams are FCC de-propanizer overhead and coker de-propanizer overhead. The major portion of the olefins in these streams may comprise propylene. In that case, the concentration of the olefins in the olefin-containing stream may preferably be between about 30% and 90% by volume, more preferably between about 50% and 80% by volume.

Since propylene is typically more active than ethylene in alkylating light aromatics, this group of refinery streams can usually achieve higher percentages of benzene conversion. Furthermore, since more than one stream of olefin-containing streams can be used simultaneously, a combination of the olefin-containing streams can often provide the most economical combination of olefins in fuel gas and high benzene conversion.

In the practice of this invention it is preferred that the ratio of olefin, in the olefin-containing stream, to benzene, in the complex refinery stream containing a minor amount of benzene, be stoichiometric, or more preferably, with excess olefin, most preferably, greatly in excess olefin, in the realization that other reactants for olefin exist in the complex refinery stream. Specifically, the goal of the invention is to maximize the alkylation of benzene, as well as other light aromatics, and to minimize the amount of benzene in the complex refinery stream recovered from the process. Consequently, unlike the catalytic processes heretofore disclosed, and unlike even the distillation catalytic processes heretofore disclosed, the process of this invention will use an olefin-containing stream containing a reactive excess of olefin, preferably much in excess of the stoichiometric amount, generally in a mol ratio of benzene to olefin (preferably propylene) of about one or less, preferably of about 0.5 or less.

DISTILLATION COLUMN

One of the unique features of the preferred embodiment of the present invention is its use of a distillation column, integral with the refinery process, for the alkylation reaction. This contrasts with prior art teaching suggesting the use of fixed bed reactors. This has a number of process advantages. First and most importantly, it permits the concurrent or countercurrent flow of the reaction streams while facilitating the generally simultaneous catalytic alkylation reaction and the distillation of some reaction products. Secondly, it allows for the use of an existing column which may be in place in the refinery inventory. The distillation column may, however, also be a separate dedicated vessel.

One particular preferred embodiment involves using an existing FCC absorber column as the distillation column of choice. The advantage to using the absorber is that, as described in greater detail below, the aromatics-containing stream serves as the sponge oil, as well as the source of alkylation reactants.

In a preferred embodiment, a complex refinery stream containing light aromatics and a minor amount of benzene is fed into the lower part of a distillation column reactor which is packed with one or several beds of catalysts separated by distillation packings. Concurrently, one or more olefin-containing streams are fed into the lower end of the fixed beds of catalysts. Alkylation of the aromatics takes place inside the column in the presence of catalyst. A portion of the unreacted components and the resulting heavier products flows downwardly and is removed at or near the bottom of the column. This is either returned to the main fractionator for further distillation or sent directly to storage for gasoline blending. The unreacted olefin-containing streams and some entrained liquid components flow upwardly and are partially condensed in an overhead condemner. Part of the liquid is returned to the column as distillation reflux. The uncondensed gas is sent to the refinery fuel gas system and part of the condensed liquid is sent to storage for gasoline blending.

It is contemplated that the reaction may be carried out in either concurrent or counter-current flow. In a concurrent arrangement, all reaction streams are introduced into the lower part of the distillation column. Olefin-containing gas is distributed into several streams in order to minimize multialkylation of aromatic rings. In a countercurrent arrangement, the liquid stream is introduced into the upper part of the distillation column while the vapor stream is introduced into the lower part the column.

In one embodiment of the present invention (using absorber countercurrent flow) the alkylation reaction is conducted using light reformate as the aromatics-containing stream, FCC off-gas and/or de-propanizer overhead as the olefin-containing stream, and a refinery-integral FCC absorber as the distillation column reactor.

The absorber ordinarily uses a sponge oil, such as FCC light cycle oil or heavy gasoline, to absorb and thereby remove heavier olefins from the refinery stream. This results generally in an overhead ethylene-rich stream containing ethylene, propylene, and some butene. In the preferred embodiment of the present invention, the aromatics-containing stream is essentially functioning as the sponge oil, and simultaneously catalytically reacting with olefins in the olefin-containing stream.

In another embodiment, either de-ethanizer overhead gas which contains principally hydrogen, methane, ethylene and ethane gas, and may also have entrained some propylene, propane, butylene, isobutane, n-butane and heavier hydrocarbons, and/or a de-propanizer overhead gas, which is similar but contains a preponderance of propylene and propane, is fed into the lower part of a distillation column and flows upwards. A stream of reformate, preferably light reformate, is introduced to the top part of the column and flows downwards. Alkylation of benzene and light aromatics takes place inside the column in the presence of a catalyst and the resulting products flow downwardly. The reformate also acts as sponge oil and picks up heavy hydrocarbons such as $C_3$'s, $C_4$'s and heavier hydrocarbons. The enriched liquid stream containing alkylation product is recovered near the bottom of the column and is either returned to the main fractionator for further distillation or can be used as a gasoline blending stock. The de-olefinized gas and the vaporized components of the reformate are partially condensed in an overhead condenser and part of the condensed liquid is returned to the column as distillation reflux.

The preferred process conditions for operating the distillation column reactor include a temperature of between about 90°-500° F., preferably between about 200°-500° F., and a pressure of between about 30-500 psi, preferably between about 50-200 psi.

ALKYLATION CATALYST

The desirable chemical reactions are facilitated with the presence of a suitable catalyst. Examples of catalysts suitable for aromatics alkylation include shape-selective zeolites such as ZSM-5, high silica/alumina ratio especially high silica/alumina ratio form of ZSM-5), zeolite beta (sometimes referred to as beta zeolite), hydrogen or rare earth-exchanged Y zeolite. Phosphoric acid on kieselguhr catalyst, phosphoric acid on silica, solid phosphorio acid (SPA), and Friedel Crafts catalysts such as aluminum chloride are also suitable. The preferred catalysts include zeolite beta and Y zeolites, preferably LZY-82, LZ-20, and LZ-210 zeolites. It is especially preferred to use zeolite beta and LZY-82 zeolites. The catalysts may be formed in any conventional manner but two favored methods are by either extrudating or spray-drying.

The LZY-82 zeolite is structurally and spectroscopically defined and can be fabricated using such procedures as are set forth in U.S. Pat. No. 3,130,007 and as are also set forth in, inter alia, the books "Molecular Sieves—Principles of Synthesis and Identification" by R. Szostak, Van Nostrand Reinhold, New York, 1989 and "Zeolite Chemistry and Catalysis" by Jule A. Rabo, ACS Monograph 171, American Chemical Society, 1976, each of which is incorporated herein by reference. Zeolite beta is also defined in the above mentioned books.

Zeolite beta is a synthetic crystalline aluminosilicate originally described in U.S. Pat. Nos. 3,308,069 and Re. 28,341, to which reference is made for further details of this zeolite, its preparation and properties, and which is incorporated herein by reference. Its use in an alkylation process similar to that of the present invention is disclosed in U.S. Pat. No. 4,891,458, Innes, et al., issued Jan. 2, 1990, also incorporated herein by reference.

U.S. Pat. Nos. 3,308,069 and Re. 28,341 describe the composition of zeolite beta in its as synthesized form as follows:

$$[XNa(1.0\pm0.1-X)TEA]AlO_2\ Y\ SiO_2\ W\ H_2O$$

wherein X is less than 1, preferably less than 0.75, TEA represents tetraethylammonium ion, Y is greater than 5 and less than 100, and W is up to about 4, depending on the condition of dehydration and on the metal cation present. These patents also teach that the sodium may be replaced by another metal ion using ion exchange techniques.

Subsequent publications such as European Patent Applications Nos. 95,304, 159,846, 159,847 and 164,939 have broadened the definition of zeolite beta to include materials prepared using templating agents other than tetraethylammonium hydroxide and materials having Si/Al atomic ratios greater than 100. Also, the zeolites described in European Patent Applications Nos. 55,046 and 64,328 and British Patent Application No. 2,024,790 have structures and X-ray diffraction patterns very similar to that of zeolite beta and are included within the scope of the term "zeolite beta", as used herein.

The forms of zeolite beta which are most useful in the present invention are crystalline aluminosilicates having the empirical formula:

$$(X/n)\ M\cdot(1.0\pm0.1-X)\ Q\cdot AlO_2\cdot Y\ SiO_2\cdot W\ H_2O$$

wherein X is less than 1, preferably less than 0.75, Y is greater than 5 and less than 100, W is up to about 4, M is a metal ion, n is the valence of M, and Q is a hydrogen ion, an ammonium ion or an organic cation, or a mixture thereof. For purposes of the present invention, Y is preferably greater than 5 and less than about 50. Consequently, the silicon to aluminum atomic ratio in the above formula is greater than 5:1 and less than 100:1, and preferably greater than 5:1 and less than about 50:1. It is also contemplated that other elements, such as gallium, boron and iron, can be variably substituted for aluminum in the above formula. Similarly, elements such as germanium and phosphorous can be variably substituted for silicon.

Suitable organic cations are those cations which are derived in aqueous solution from tetraethylammonium bromide or hydroxide, dibenzyl-1,4-diazabioyclo[2.2.-2]octane chloride, dimethyldibenzyl ammonium chloride, 1,4-di(1-azoniumbioyolo[2.2.2]-octane)butane dibromide or dihydroxide, and the like. These organic cations are known in the art and are described, for example, in European Patent Applications Nos. 159,846 and 159,847, and U.S. Pat. No. 4,508,837. The preferred organic cation is the tetraethylammonium ion.

M is typically a sodium ion from the original synthesis but may also be a metal ion added by ion exchange techniques. Suitable metal ions include those from Groups IA, IIA or IIIA of the Periodic Table or a transition metal. Examples of such ions include ions of lithium, potassium, calcium, magnesium, barium, lanthanum, cerium, nickel, platinum, palladium, and the like.

For high catalytic activity, the zeolite beta should be predominantly in its hydrogen ion form. Generally, the zeolite is converted to its hydrogen form by ammonium exchange followed by alcination. If the zeolite is synthesized with a high enough ratio of organonitrogen cation to sodium ion, calcination alone may be sufficient. It is preferred that, after calcination, a major portion of the cation sites are occupied by hydrogen ions and/or rare earth ions. It is especially preferred that at least 80% of the cation sites are occupied by hydrogen ions and/or rare earth ions.

The zeolite beta should preferably be calcined at a calcining temperature below about 1050° F., preferably in a range from about 900° F. to about 1050° F.

The pure zeolite may be used as a catalyst, but generally it is preferred to mix the zeolite powder with an inorganic oxide binder such as alumina, silica, silica/alumina, or naturally occurring clays and form the mixture into tablets or extrudates. The final catalyst may contain from 1 to 99 weight percent zeolite. Usually the zeolite content will range from 10 to 90 weight percent, and more typically from 60 to 80 weight percent. The preferred inorganic binder is alumina. The mixture may be formed into tablets or extrudates having the desired shape by methods well known in the art. The extrudates or tablets will usually be cylindrical in shape. Other shapes with enhanced surface-to-volume ratios, such as fluted or poly-lobed cylinders, can be employed to enhance mass transfer rates and, thus, catalytic activity.

Part of the distillation column is preferably packed with catalytic material which incorporates the suitable catalyst discussed above. For example, zeolite catalysts may be spray-dried or extrudated with proper bindings. Sulfonic acid may be ion-exchanged into resins which are then prepared in granular or bead form. The catalysts may also be combined with other suitable materials and made into a shape of conventional distillation packing such as Penn State packings, Pall rings, saddles or the like. Other packing shapes include Gempak high efficiency structured packing and Cascade MiniRings. The catalytic material may be located either in a series of zones or one particular part of the distillation column where the liquid and the vapor streams are in contact. Because the alkylation reactions are exothermic, dividing up the catalytic material into several zones will help minimize local high temperatures. The material is arranged such that it provides a sufficient surface area for catalytic contact of the reaction streams.

Generally at least about 30% of the benzene initially present in the light reformate fraction is alkylated under the selected alkylation conditions. More preferably, at least about 40%, and most preferably at least about 50%, of the benzene initially present is alkylated. Because of the 200° F. cutoff temperature of the light reformate fraction (this cutoff temperature can also advantageously be used for other refinery streams which may be processed in accordance with the present invention) methyl, ethyl and propyl benzene derivatives do not enter the alkylation zone since they are included with the heavy 200° F.+reformate which is, in accordance with an embodiment of the present invention, separated from a full boiling range $C_5$+ reformate or other refinery stream prior to the alkylation step.

The post-alkylation lighter benzene-containing stream from the alkylation zone which is substantially free of alkylated benzene. either due to the alkylation being carried out in the primary distillation column or due to the alkylated benzene being separated by a secondary distillation column, is reacted with hydrogen in a hydrogenation zone in the presence of a hydrogenation catalyst under hydrogenation conditions selected to hydrogenate substantially all of the remaining (non-alkylated) benzene to form a debenzenated product. The preferred hydrogenation conditions include a temperature which falls within a range from about 300° F. to about 500° F., a pressure which falls within a range from about 200 psig to about 500 psig, a hydrogen to hydrocarbon mole ratio which falls within a range from about 0.5 to about 10, preferably from about 0.5 to about 5 and more preferably from about 1 to about 3 and a LHSV which falls within a range from about 1 to about 5.

The hydrogenation catalyst may comprise substantially any catalyst capable of catalyzing the hydrogenation of benzene to cyclohexane. Such a catalyst will comprise a Group VIII metal on a porous inorganic oxide support, for example an alumina support, a silica support, an aluminosilicate, such as a zeolite. The preferred Group VIII metals include platinum and palladium with platinum being more preferred. The hydrogen to hydrocarbon mole ratio is usually 1:1 or greater.

The post-hydrogenation stream, which includes $C_5$–$C_7$ paraffins, is contacted in an isomerization zone with an isomerization catalyst under isomerization conditions to produce an isomerized product. Such conditions can be a temperature which falls in a range from about 300° F. to about 500° F., a pressure which falls in a range from about 200 psig to about 500 psig and a LHSV which falls in a range from about 1 to about 5. The isomerization catalyst can comprise a Group VIII metal, preferably platinum or palladium, more preferably platinum, on a porous inorganic oxide support, for example alumina, silica/alumina or an aluminosilicate such as a zeolite. If the support itself does not have sufficient acidity to promote the needed isomerization reactions such acidity can be added, for example, by chloriding the catalyst. Thus, chlorided alumina is a suitable catalytic support. The various zeolites can be utilized as catalytic supports without the necessity for chloriding. If zeolitic supports are utilized it is generally preferred that they not be alkali neutralized.

Preferred hydrogenation catalysts comprise platinum on alumina and platinum on a zeolite with alumina binder added for strength. Suitable zeolites include faujasite, mordenite and synthetic alumino-silicates.

Suitable isomerization catalysts comprise platinum on chlorided alumina and platinum on a zeolite which has an acidic function for promoting isomerization. Suitable zeolites include faujasite, mordenite and synthetic alumino-silicates.

A dual function isomerization and hydrogenation catalyst which combines the attributes of the above-listed catalyst types can also be used, in which case hydrogenation and isomerization can occur simultaneously.

In accordance with the preferred embodiment of the present invention as illustrated in FIG. 1 a single catalytic distillation reactor is used for the distillation and alkylation steps of the invention and the hydrogenation zone and the isomerization zone are combined into a single combined hydrogenation-isomerization reactor which then operates under combined hydrogenation-isomerization conditions, again at a temperature which falls within a range from about 300° F. to about 500° F., a pressure which falls in a range from about 200 psig to about 500 psig and a LHSV which falls in a range from about 1 to about 5. The debenzenated, hydrogenated and isomerized product, which is usually combined with the heavy fraction from the primary distillation column, comprises a substantially benzene-free gasoline or gasoline blending stock.

Figure 3:
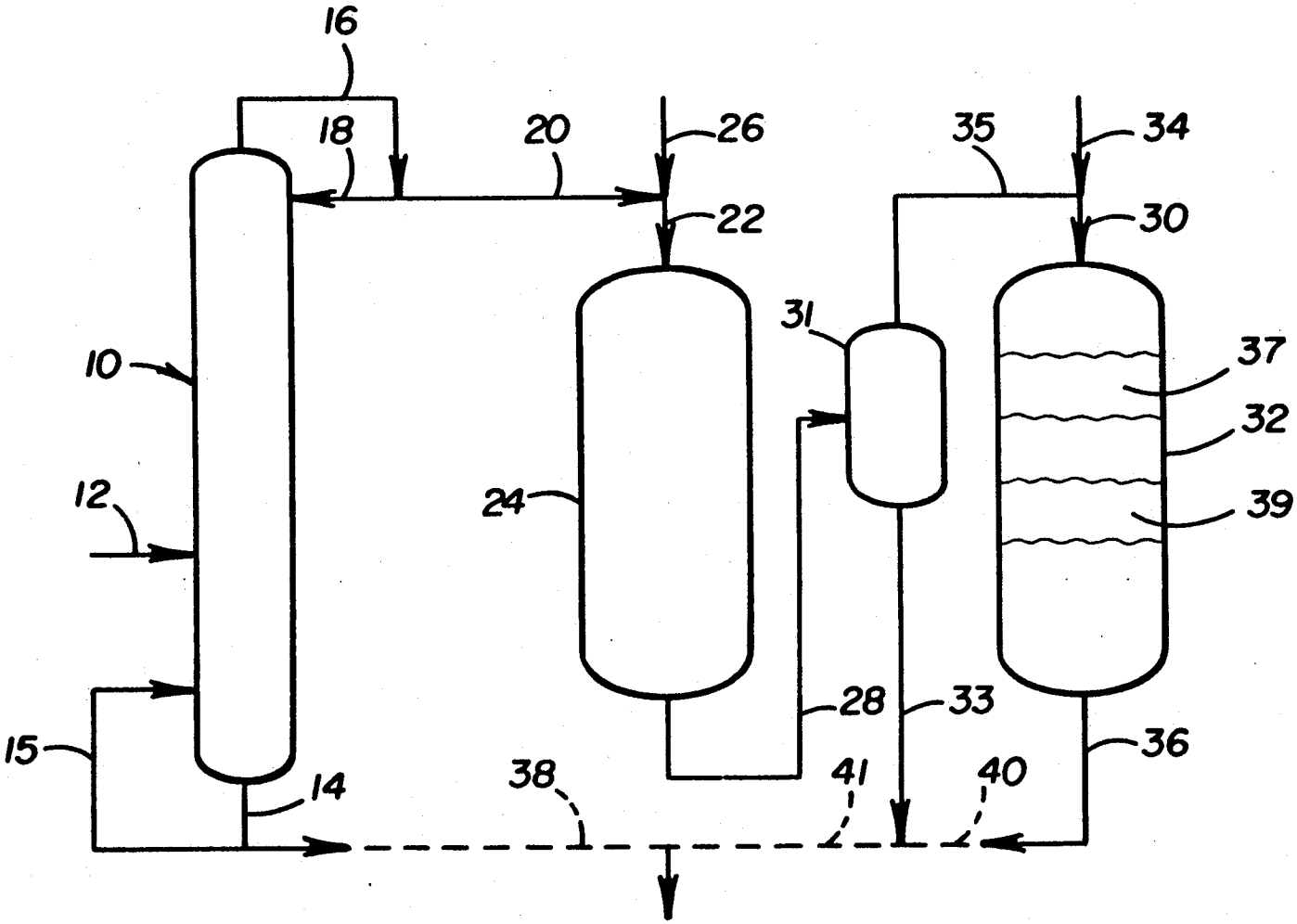
FIG. 3 is a schematic representation of yet another embodiment in accordance with the present invention.
Figure 4:
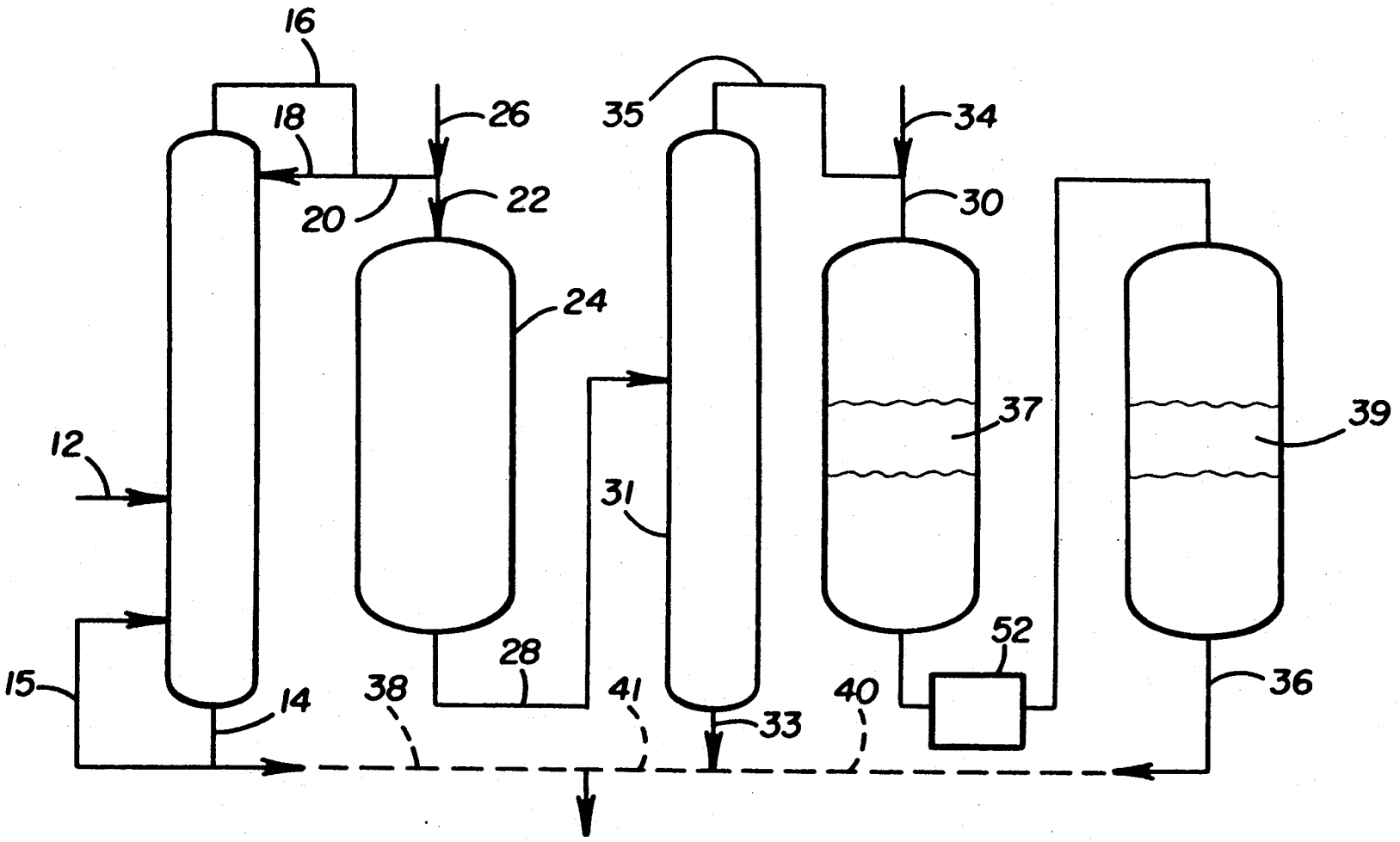
FIG. 4 is a schematic representation of still another embodiment in accordance with the present invention.

An example of the operation of the process of the present invention on a particular refinery stream, namely a full boiling range $C_5+$ reformate of a selected RON, for example 100 RON, may be helpful to an understanding of the invention. Referring to FIG. 3, wherein a simple distillation column 10 is utilized rather than the catalytic distillation column 110 of FIGS. 1 and 2, such a reformate enters the distillation column 10 via line 12. In the distillation column 10 separation occurs whereby a heavy reformate, i.e., 200° F. reformate, exits via line 14. A portion of the heavy reformate can be recycled to the distillation column 10 via line 15 to improve separation efficiency. A $C_5-200°$ F. light reformate fraction exits the distillation column 10 via a line 16. A portion of the light reformate fraction can be recycled to the distillation column 10 via line 18 to improve separation efficiency. The light reformate fraction is passed via line 20 and line 22 to an alkylation zone 24 along with olefins which enter the alkylation zone 24 via lines 26 and 22. An alkylated stream carrying both alkylated and nonalkylated benzene exits the alkylation zone 24 via a line 28 and enters a secondary distillation column 31 whereat a heavy fraction containing the alkylated benzene is removed via a line 33. It may be used as a portion of the final product gasoline blending stock. The light post-alkylation fraction from the secondary distillation column 31 is passed via a line 35 to a combined hydrogenation-isomerization reactor 32 having a hydrogenation zone 37 and an isomerization zone 39 (separate reactors can be utilized for each type of reaction, if desired as is illustrated in FIG. 4). Hydrogen also enters the hydrogenation-isomerization reactor 32 via lines 34 and 30. The hydrogenated and isomerized product from the hydrogenation-isomerization reactor 32 exits via a line 36. It may be combined with the heavy reformate exiting the distillation column 10 via the line 14 as indicated by the dashed lines 38 and 40 and also with the heavy fraction from the secondary distillation column 31 as indicated. by the dashed line 41.

FIGS. 1 illustrates the a preferred embodiment of the present invention wherein the alkylation zone 24 is within the distillation column 110 and the hydrogenation and isomerization reactions are carried forth in the same reactor 32. The $C_5+$ reformate enters the distillation column 110 via the line 12. The olefins enter the distillation column 110 via line 42. The heavy reformate (including alkylated benzene formed in the alkylation zone 24) exits the distillation column 110 via the line 14. As will be apparent, the olefins entering the distillation column 110 via the line 42 and the light fraction pass upwardly in the distillation column 110 and into the alkylation zone 24 whereat alkylation occurs.

The light (alkylated benzene-free and benzene-containing) fraction from the alkylation zone 24 exits the distillation column 110 via a line 44. A portion of the light fraction can be recycled to the top portion of the distillation column 110 via a line 46 as a reflux to the distillation operation. The light fraction continues via line 48 and line 50 to the hydrogenation-isomerization reactor 32 which contains both a hydrogenation zone 37 and an isomerization zone 39. Hydrogen enters the hydrogenation-isomerization zone 32 via lines 34 and 50. The isomerized and debenzenated product exits the hydrogenation-isomerization zone via the line 36 and may be combined with the heavy reformate via the lines 38 and 40 as with the embodiments of FIGS. 2 and 3.

In accordance with another embodiment of the invention the alkylation and distillation are carried out in a single catalytic distillation reactor 110 while the hydrogenation and the isomerization are carried out in separate reactors 137 and 139. This is the embodiment illustrated in FIG. 2 of the drawings. Hydrogen can be added via lines 50 and/or 150 to the isomerization reactor 137 and to the hydrogenation reactor 139. Although not illustrated in FIG. 2, cooling can be provided, e.g., via a heat exchanger, between the hydrogenation zone 37 and the isomerization zone 39 to compensate for any temperature rise caused by the exothermic hydrogenation reactions. With the exception of the separate hydrogenation and isomerization reactors the embodiment of FIG. 2 is identical to that of FIG. 1 and does not require further description.

FIG. 4 illustrates an embodiment like that of FIG. 3 but with separate hydrogenation and isomerization reactors. A heat exchanger 52 is present between the hydrogenation zone 37 and the isomerization zone 39.

Figure 2:
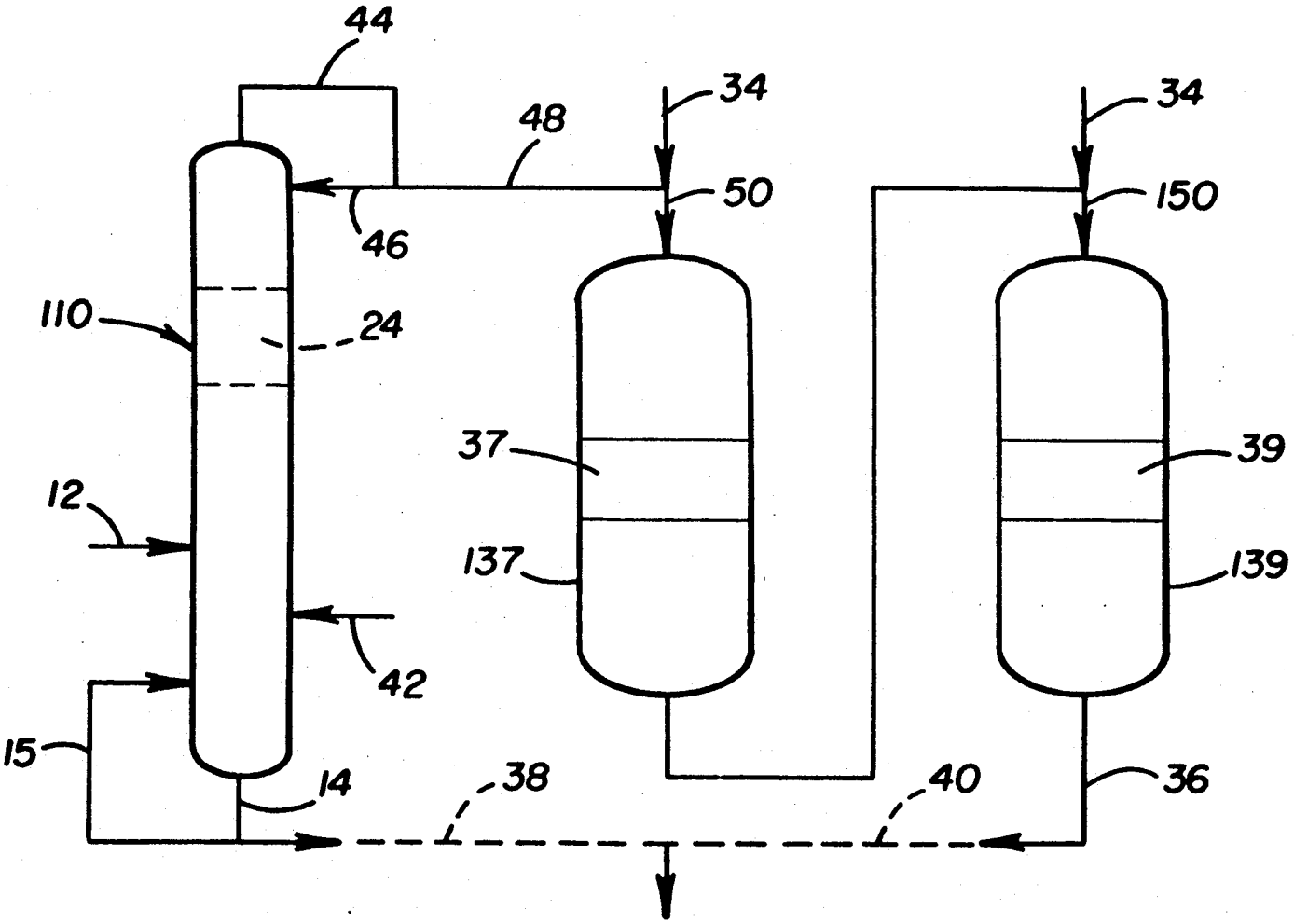
FIG. 2 is a schematic representation of another embodiment in accordance with the present invention.

Note that in the embodiments of FIGS. 1 and 2 the preferred feed is of the full boiling range variety, e.g., a full boiling range reformate, whereby a prior distillation step to separate heavier hydrocarbons is not needed. In the embodiments of FIGS. 3 and 4 the initial distillation column can be omitted if a light feed, e.g., a light reformate, is fed via line 20 to the alkylation zone 24.

The following examples are provided to illustrate the invention in accordance with the principles of the invention, but are not to be construed as limiting the invention in any way except as indicated by the claims.

EXAMPLE 1

Preparation of a Simulated FCC Off-gas

A simulated FCC off-gas was prepared by mixing various gases to arrive at the following composition:

| Component | Volume % |
|---|---|
| Hydrogen | 30.0 |
| Methane | 30.0 |
| Ethane | 15.0 |
| Ethylene | 15.0 |
| Propane | 5.0 |
| Propylene | 5.0 |

EXAMPLE 2

Procuring a Reformate Feed

A complex reformate feed containing a typical concentration of benzene was obtained by withdrawing whole reformate products from two commercial reformers over a period of several hours and blending the products. The composite has the following properties:

| Component | Weight % |
|---|---|
| Benzene | 6.9 |
| Toluene | 20.6 |
| Xylenes | 24.4 |
| Other Constituents | 48.1 |
| Gravity, API | 40.3 |
| RON | 100.5 |
| MON | 90.0 |
| TBP Distillation | F |
| Volume % | |
| 0 | 32 |

-continued

| | |
|---|---|
| 5 | 97 |
| 10 | 140 |
| 30 | 231 |
| 50 | 246 |
| 70 | 292 |
| 90 | 337 |
| 95 | 362 |
| 100 | 420 |

EXAMPLE 3

Preparation of a Light Reformate Feed

A light reformate feed containing a minor amount of benzene was prepared by distilling the reformate feed in Example 2 to remove the heavier portion. It has the following properties:

| Component | Weight % |
|---|---|
| Benzene | 22.3 |
| Toluene | 4.5 |
| Xylenes | 0.0 |
| Other Constituents | 73.2 |
| Gravity, API | 69.3 |
| RON | 76.5 |
| MON | 75.5 |
| TBP Distillation | F |
| Volume % | |
| 0 | 32 |
| 5 | 82 |
| 10 | 97 |
| 30 | 140 |
| 50 | 156 |
| 70 | 176 |
| 90 | 197 |
| 95 | 209 |
| 100 | 230 |

EXAMPLE 4

Benzene Conversion Using Single Stage Reactor

In this example the light reformate feed of Example 3 was alkylated in a catalytic distillation reactor to obtain about 30% conversion of benzene. The catalyst used was a commercially available Y zeolite, namely, LZY-82 catalyst obtained from Union Carbide Company. The feed was pumped into a catalytic distillation reactor (CDR) where reaction and separation occurred. Alkylated benzenes were removed with the heavier fraction while any remaining benzene and more volatile components were removed with the lighter fraction. The olefin stream used was the simulated FCC off gas of Example 1 Reaction conditions were: pressure, 200 psig; catalyst temperature, 430° F.; feedrate, 200 cc/hr (140 gms/hr). The test was run for 5 hours. The following table summarizes the experimental results:

| Feed Pumped | Light Fraction | Heavy Fraction |
|---|---|---|
| 733.0 gms of 22.3 wt % benzene feed (163.4 gms of benzene) | 606.0 gms | 225.1 gms |
| | 18.4 wt % benzene (111.5 gms) | 11.2 wt % benzene (25.2 gms) |

Thus, the incoming 163.4 gms of benzene was reduced to 136.7 gms of benzene (111.5 gms plus 25.2 gms) in the product. The percent benzene conversion is therefore calculated to be 16.4% based on these data. However, it is noted that the sum of the product weights is about 10% more than the feed weight in this case. Errors in the weight balance can occur for several reasons. First, no corrections are made for $C_5+$ product which can be carried out with gases and in the particular test apparatus utilized separation was considerably less than is normally attained in commercial operations. Second, considerable product can be drawn off (or held up in) the test apparatus if the liquid levels in the apparatus (i.e., overhead and bottoms product accumulators) are not carefully maintained at constant levels. Such was not done in the experiment performed. Accordingly, this latter reason is believed to be the major reason for the discrepancies in the weight balance. Third, a leak can occur in the gas system causing loss of gas or overhead vapor. If the weight balance is corrected to make the weight of the products match the weight of the feed a normalized benzene conversion can be calculated. In this experiment the normalized benzene conversion calculates out to be about 24%.

This example illustrates the attainment of about 24% benzene conversion in a CDR unit via benzene alkylation.

EXAMPLE 5

Hydrogenation Of Light Reformate

In this example a light reformate feed of the same composition as was used in Example 4 was contacted with hydrogen over a hydrogenation catalyst at hydrogenation conditions to convert 50% or more of the benzene to cyclohexane. The catalyst used was platinum on an alumina base. The conditions used were a liquid feed rate of 190 cc/hr (LHSV of 0.95), a $H_2$ gas rate of 1.8 gm moles/hr, a pressure of 150 psig and a catalyst temperature of 400° F. The product collected in a 4.5 hour yield period was 663.7 gms of overhead and no bottoms product. The benzene concentration of the feed was 22.3 weight %, the benzene in overhead was 1.3 weight % and the benzene conversion was 47% without correction for mass balance. When the benzene conversion was normalized for weight balance, the benzene conversion was calculated to be 52.2 weight %.

This example shows that a significant amount of benzene (about 50%) can be hydrogenated even at a relatively low pressure of 150 psig.

EXAMPLE 6

Combined CDR Alkylation and Hydrogenation

In this example the light reformate feed of Example 3 was alkylated in a catalytic distillation reactor and the light fraction was then hydrogenated (but not isomerized) to obtain about 60% conversion of benzene. The catalyst used was a commercially available Y zeolite, namely, LZY-82 catalyst obtained from Union Carbide Company. The feed was pumped into a catalytic distillation reactor (CDR) where reaction and separation occurred. Alkylated benzenes were removed with the heavier fraction while any remaining benzene and more volatile components were removed with the lighter fraction. The olefin stream used was the simulated FCC off gas of Example 1. Reaction conditions were: pressure, 200 psig; catalyst volume, 200 cc; catalyst temperature, 430° F.; feedrate, 200 cc/hr (140 gms/hr). The test was run for 5 hours. The lighter fraction was then catalytically hydrogenated over a platinum on alumina catalyst at a pressure of 150 psig and at a catalyst temperature of 400° F. The following table summarizes the experimental results:

| Feed Pumped | CDR Heavy Fraction | Hydrogenated Product |
|---|---|---|
| 669.8 gms of 22.3 wt % benzene feed (149.4 gms of benzene) | 116.4 gms | 583.7 gms |
| | 14.7 wt % benzene (17.1 gms) | 7.7 wt % benzene (44.9 gms) |

Thus, the incoming 149.4 gms of benzene was reduced to 62.0 gms of benzene (17.1 gms plus 44.9 gms) in the product. The percent benzene conversion is calculated as 58% benzene conversion. In this experiment the material balance was slightly low for the reasons stated in Example 4.

This example illustrates the higher degree of benzene conversion attainable when hydrogenation follows alkylation.

EXAMPLE 7

Alkylation Using Propylene Containing Gas

In this example a light reformate feed was alkylated using a propylene containing gas mixture. The gas mixture for this example had a composition of 80 mol % $H_2$, 15 mol % propylene and 5 mol % propane. This ratio of propylene to propane is approximately in the proportions of that commonly produced by FCC units. The hydrogen was added as a carrier gas for the purposes of metering a particular amount into the test apparatus. The catalyst used for this test was LZY-82. The conditions were a feedrate of cc/hr (LHSV of 1.1), a pressure of 200 psig and a catalyst temperature of 430° F. The reaction was carried out in a catalytic distillation reactor as in the previous examples. The test was run for a period of 5.5 hours. The amount of feed pumped was 846.0 gms and the amounts of products collected were 648.5 gms of overhead and 227.1 gms of bottoms. The benzene contents of the streams were analyzed as follows: feed 22.3 weight % benzene, overhead 15.9 weight % benzene and bottoms 11.1 weight % benzene. The amount of benzene conversion was calculated as 32.0% (32.6% when the mass balance was normalized).

This example shows that a propylene containing gas mixture is also suitable for conducting the alkylation reaction.

EXAMPLE 8

Alkylation Using A Beta Zeolite Catalyst

In this example a light reformate feed was alkylated with a simulated offgas mixture using a Beta Zeolite catalyst. The conditions for this test were a feedrate of 200 cc/hr, pressure of 200 psig and a catalyst temperature of 430° F. The test was run for a period of 16.0 hours in a catalytic distillation reactor. The amount of feed pumped was 2240 gms and the amounts of products collected were 1442.0 gms of overhead and 685.0 gms of bottoms. The benzene analyses of these streams were: feed 22.3 weight % benzene, overhead 17.0 weight % benzene and bottoms 14.4 weight % benzene. The amount of benzene conversion was calculated to be 31.8% (28.6% when normalized for the mass balance).

This example shows that Beta Zeolite catalyst is also suitable for conducting the alkylation of a light reformate with an olefin containing gas.

EXAMPLE 9

Hydrogenation Of Light Reformate At Higher Temperature and Pressure

In this example a light reformate feed was hydrogenated using a hydrogenation catalyst at higher pressure than that used in Example 5. The catalyst used was a platinum on alumina catalyst.

The test conditions were a liquid feedrate of 180 cc/hr (LHSV of 0.9), a pressure of 300 psig and a catalyst temperature of 470° F. A flow rate of $H_2$ gas of 1.5 ft/3 hr (1.8 gm moles/hour) was used. The test was run for a period of 5.0 hours. The amount of feed pumped was 641.6 gms and the amount of overhead product collected was 597.5 gms. There was no bottoms product collected in this case. The benzene content of the feed was 22.3 weight % and that of the overhead product was 0.6 weight %. The benzene conversion can be calculated at 98.0% (97.5% when normalized for mass balance).

This example shows that a high degree of benzene conversion is possible when the hydrogenation conditions are more severe (higher temperature and pressure).

EXAMPLE 10

Isomerization Of A Light Reformate

This example is a calculation showing the effect of using a catalyst for hydrogenation which also includes some isomerization activity. Isomerization catalysts are commonly made to contain platinum on chlorided alumina or platinum on zeolite supports. The conditions for this example are the same as in Example 9 (i.e. feedrate of 200 cc/hr, pressure of 300 psig and catalyst temperature of 470° F. A high degree of benzene conversion is expected as is shown in Example 9. The isomerization activity of this catalyst also converts normal paraffins to isomers which upgrades their octane rating. The light reformate feed contains pentanes and hexanes which can be upgraded by isomerization. An approximation of the amount of isomerization is given as follows:

| Component (RON) | Feed, wt % | Product, wt % |
|---|---|---|
| n-Pentane (62) | 6.8 | 4.1 |
| i-Pentane (92) | 8.3 | 11.0 |
| n-Hexane (26) | 10.2 | 4.7 |
| 2-Methylpentane (74) + 3-Methylpentane | 21.2 | 26.7 |
| Methylcyclopentane (90) | 2.0 | 2.0 |
| Benzene (98) | 22.3 | 1.0 |
| Cyolohexane (83) | 0.4 | 21.7 |
| Other components (72) | 28.8 | 28.8 |
| Calculated octane | 75.0 | 75.6 |

This example shows that significant conversion of n-paraffins to iso-paraffins will occur over isomerization catalysts. The overall effect is that the octane of a light reformate can be increased slightly even though the hydrogenation of benzene to cyclohexane is occurring which contributes to a loss in the octane rating of the stream.

Table 1, which follows, summarizes the experimental data from Examples 4–9 and the calculation of Example 10. The data and information in Table 1 demonstrates that volume can be maintained or increased without loss in octane numbers when benzene is converted in accordance with the invention.

TABLE 1

| | Example No. | | |
|---|---|---|---|
| | 4 | 5 | 6 |
| | Run No. | | |
| | 120 | B-25 | 135 |
| | Treatment | | |
| | Alkylation | Hydrogenation | Alkyl + Hydrog |
| | Catalyst | | |
| | LZY-82 | $Pt/Al_2O_3$ | $LZY-82/Pt/Al_2O_3$ |
| Pressure, psig | 200 | 150 | 200/150 |
| Temperature, °F. | 430 | 400 | 430/400 |
| Olefin Gas | Offgas | $H_2$ | Offgas/$H_2$ |
| Feedrate, cc/hr | 208 | 190 | 200 |
| Yield Time, hrs | 5.0 | 4.5 | 5.0 |
| Wt. Feed, gms | 733.2 | 634.5 | 669.8 |
| Wt. Feed, gms/hr | 146.6 | 141.0 | 134.0 |
| Wt. Overhead, gms | 606.0 | 663.7 | 583.7 |
| Wt., Bottoms, gms | 225.2 | 0.0 | 116.4 |
| Wt. Out Gas, gms/hr | 49.3 | 12.8 | 33.4 |
| Pdct. Tot. Wt., gms/hr | 215.5 | 160.2 | 173.5 |
| Input Tot. Wt., gms/hr | 194.2 | 144.6 | 180.6 |
| Wt. Balance, wt. % | 110.0 | 110.8 | 96.0 |
| Feed $C_6H_6$, wt. % | 22.3 | 22.3 | 22.3 |
| Overhead $C_6H_6$, wt. % | 18.4 | 11.3 | 7.7 |
| Bottoms $C_6H_6$, wt. % | 11.2 | — | 14.7 |
| Meas. $C_6H_6$ Conv., wt. % | 16.4 | 47.0 | 58.3 |
| Norm. $C_6H_6$ Conv., wt. % | 24.6 | 52.2 | 56.6 |

| | Example No. | | |
|---|---|---|---|
| | 7 | 8 | 9 |
| | Run No. | | |
| | 121 | 13 | B-27 |
| | Treatment | | |
| | Alkylation | Alkylation | Hydrogenation |
| | Catalyst | | |
| | LZY-82 | Beta Zeolite | $Pt/Al_2O_3$ |
| Pressure, psig | 200 | 200 | 300 |
| Temperature, °F. | 430 | 430 | 470 |
| Olefin Gas | $H_2/C_3/C_3=$ | Offgas | $H_2$ |
| Feedrate, cc/hr | 220 | 200 | 180 |
| Yield Time, hrs | 5.5 | 16.0 | 5.0 |
| Wt. Feed, gms | 846.0 | 2240 | 641.6 |
| Wt. Feed, gms/hr | 153.8 | 140.0 | 128.3 |
| Wt. Overhead, gms | 648.5 | 1442.0 | 597.5 |
| Wt., Bottoms, gms | 227.1 | 685.0 | 0.0 |
| Wt. Out Gas, gms/hr | 22.4 | 16.4 | 5.9 |
| Pdct. Tot. Wt., gms/hr | 181.6 | 149.4 | 125.4 |
| Input Tot. Wt., gms/hr | 180.0 | 156.4 | 131.9 |
| Wt. Balance, wt. % | 100.9 | 95.5 | 95.1 |
| Feed $C_6H_6$, wt. % | 22.3 | 22.5 | 22.3 |
| Overhead $C_6H_6$, wt. % | 15.9 | 17.0 | 0.6 |
| Bottoms $C_6H_6$, wt. % | 11.1 | 14.4 | — |
| Meas. $C_6H_6$ Conv., wt. % | 32.0 | 31.8 | 97.6 |
| Norm. $C_6H_6$ Conv., wt. % | 32.6 | 28.6 | 97.5 |

INDUSTRIAL APPLICABILITY

The present invention provides a process for producing a substantially benzene-free gasoline blending stock from a benzene-containing refinery stream. Octane number is not sacrificed by the process. Also, the volume of product is greater than that of the original benzene-containing refinery stream.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A process for producing a debenzenated and isomerized product useful as a gasoline blending stock from a benzene-containing refinery stream, comprising:

reacting the benzene-containing refinery stream in an alkylation zone with a $C_2$–$C_4$ olefin-containing stream in the presence of an alkylation catalyst under alkylation conditions, alkylating at least about 30% of the benzene initially present in the refinery stream to form an alkylated stream containing both alkylated and non-alkylated benzene;

separating the alkylated refinery stream into a substantially benzene-free heavier fraction and a benzene-containing lighter fraction;

reacting the benzene-containing lighter fraction with both (a) hydrogen in a hydrogenation zone in the presence of a hydrogenation catalyst under hydrogenation conditions, hydrogenating substantially all of the benzene to form a debenzenated product, and (b) an isomerization catalyst in an isomerization zone under isomerization conditions, producing the debenzenated and isomerized product;

the sum of the quantities of said debenzenated and isomerized product and said substantially benzene-free heavier fraction being at least equal to that of said refinery stream.

2. A process as set forth in claim 1, further characterized in that the octane number of a combined stream of the debenzenated and isomerized product and the substantially benzene-free heavier fraction is at least equal to that of said refinery stream.

3. A process as set forth in claim 2, wherein the separating step is carried out in a catalytic distillation reactor and wherein said alkylation step is carried out on the benzene-containing lighter fraction in the catalytic distillation reactor.

4. A process as set forth in claim 2, wherein said hydrogenation zone and said isomerization zone are combined within a single reactor.

5. A process as set forth in claim 4, wherein said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

6. A process as set forth in claim 4, wherein said alkylation conditions include a temperature which falls within a range from about 350° F. to about 450° F., a pressure which falls within a range from about 150 psig to about 300 psig and a LHSV (liquid hourly space velocity) which falls within a range from about 1 to about 3.

7. A process as set forth in claim 6, wherein said hydrogenation conditions and said isomerization conditions each include a temperature which falls within a range from about 300° F. to about 500° F., a pressure which falls within a range from about 200 psig to about 500 psig and a LHSV which falls within a range from about 1 to about 5, wherein said hydrogenation conditions also include a hydrogen to hydrocarbon molar ratio of from about 0.5 to about 5 and wherein said hydrogenation catalyst comprises a Group VIII metal on an inorganic oxide support and wherein said isomerization catalyst comprises a Group VIII metal on an inorganic oxide support having acidic sites.

8. A process as set forth in claim 7, wherein said Group VIII metal of said hydrogenation catalyst comprises platinum.

9. A process as set forth in claim 8, wherein said Group VIII metal of said isomerization catalyst comprises platinum.

10. A process as set forth in claim 9, wherein said inorganic oxide support of said isomerization catalyst is chlorided alumina or a zeolite.

11. A process as set forth in claim 5, wherein said hydrogenation conditions and said isomerization conditions each include a temperature which falls within a range from about 300° F. to about 500° F., a pressure which falls within a range from about 200 psig to about 500 psig and a LHSV which falls within a range from about 1 to about 5, wherein said hydrogenation conditions also include a hydrogen to hydrocarbon molar ratio of from about 0.5 to about 5 and wherein said hydrogenation catalyst comprises a Group VIII metal on an inorganic oxide support and said isomerization catalyst comprises a Group VIII metal on an inorganic oxide support having acidic sites.

12. A process as set forth in claim 11, wherein said Group VIII metal of said hydrogenation catalyst comprises platinum.

13. A process as set forth in claim 12, wherein said Group VIII metal of said isomerization catalyst comprises platinum.

14. A process as set forth in claim 13, wherein said inorganic oxide support of said isomerization catalyst is chlorided alumina or a zeolite.

15. A process as set forth in claim 14, wherein said refinery stream is obtained by the step of:

separating a $C_5+$ reformate having octane numbers of at least selected values into a light reformate fraction and a heavy reformate fraction boiling above about 200° F. and further including the step of:

combining said substantially benzene-free gasoline blending stock with said heavy reformate fraction to form a full boiling range gasoline having octane numbers of at least about said selected values.

16. A process as set forth in claim 2, wherein said refinery stream is obtained by the step of:

separating a $C_5+$ reformate having octane numbers of at least selected values into a light reformate fraction and a heavy reformate fraction boiling above about 200° F. and further including the step of:

combining said substantially benzene-free gasoline blending stock with said heavy reformate fraction to form a full boiling range gasoline having octane numbers of at least about said selected values.

17. A process as set forth in claim 16, wherein the separating step is carried out in a catalytic distillation reactor and wherein said alkylation step is carried out on the benzene-containing lighter fraction in the catalytic distillation reactor.

18. A process as set forth in claim 17, wherein said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

19. A process as set forth in claim 17, wherein said alkylation conditions include a temperature which falls within a range from about 350° F. to about 450° F., a pressure which falls within a range from about 150 psig to about 300 psig and a LHSV (liquid hourly space velocity) which falls within a range from about 1 to about 3.

20. A process as set forth in claim 19, wherein said hydrogenation conditions include a temperature which falls within a range from about 300° F. to about 500° F., a pressure which falls within a range from about 200 psig to about 500 psig, a hydrogen to hydrocarbon molar ratio which falls within a range from about 0.5 to about 5 and a LHSV which falls within a range from about 1 to about 5 and wherein said hydrogenation catalyst comprises a Group VIII metal on an inorganic oxide support.

21. A process as set forth in claim 20, wherein said Group VIII metal of said hydrogenation catalyst comprises platinum.

22. A process as set forth in claim 20, wherein said isomerization conditions include a temperature which falls within a range from about 300° F. to about 500° F., a pressure which falls within a range from about 200 psig to about 500 psig and a LHSV which falls within a range from about 1 to about 5 and wherein said isomerization catalyst comprises a Group VIII metal on an inorganic oxide support having acidic sites.

23. A process as set forth in claim 22, wherein said Group VIII metal of said isomerization catalyst comprises platinum.

24. A process as set forth in claim 23, wherein said inorganic oxide support of said isomerization catalyst is chlorided alumina or a zeolite.

25. A process as set forth in claim 18, wherein said hydrogenation conditions include a temperature which falls within a range from about 300° F. to about 500° F., a pressure which falls within a range from about 200 psig to about 500 psig, a hydrogen to hydrocarbon molar ratio which falls within a range from about 0.5 to about 5 and a LHSV which falls within a range from about 1 to about 5 and wherein said hydrogenation catalyst comprises a Group VIII metal on an inorganic oxide support.

26. A process as set forth in claim 25, wherein said Group VIII metal of said hydrogenation catalyst comprises platinum.

27. A process as set forth in claim 26, wherein said isomerization conditions include a temperature which falls within a range from about 300° F. to about 500° F., a pressure which falls within a range from about 200 psig to about 500 psig and a LHSV which falls within a range from about 1 to about 5 and wherein said isomerization catalyst comprises a Group VIII metal on an inorganic oxide support having acidic sites.

28. A process as set forth in claim 27, wherein said Group VIII metal of said isomerization catalyst comprises platinum.

29. A process as set forth in claim 28, wherein said inorganic oxide support of said isomerization catalyst is chlorided alumina or a zeolite.

30. A process as set forth in claim 16, wherein said hydrogenation zone and said isomerization zone are combined within a single reactor.

31. A process as set forth in claim 30, wherein said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

32. A process as set forth in claim 30, wherein said alkylation conditions include a temperature which falls within a range from about 350° F. to about 450° F., a pressure which falls within a range from about 150 psig to about 300 psig and a LHSV (liquid hourly space velocity) which falls within a range from about 1 to about 3.

33. A process as set forth in claim 32, wherein said hydrogenation conditions and said isomerization conditions each include a temperature which falls within a range from about 300° F. to about 500° F., a pressure which falls within a range to hydrocarbon molar ratio which falls within a range from about 0.5 to about 5 and a LHSV which falls within a range from about 1 to about 5 and wherein said hydrogenation catalyst comprises a Group VIII metal on an inorganic oxide support and wherein said isomerization catalyst comprises a Group VIII metal on an inorganic oxide support having acidic sites.

34. A process as set forth in claim 33, wherein said Group VIII metal of said hydrogenation catalyst comprises platinum.

35. A process as set forth in claim 34, wherein said Group VIII metal of said isomerization catalyst comprises platinum.

36. A process as set forth in claim 35, wherein said inorganic oxide support of said isomerization catalyst is chlorided alumina or a zeolite.

37. A process as set forth in claim 31, wherein said hydrogenation conditions and said isomerization conditions each include a temperature which falls within a range from about 300° F. to about 500° F., a pressure which falls within a range from about 200 psig to about 500 psig and a LHSV wherein said hydrogenation conditions also include a hydrogen to hydrocarbon molar ratio of from about 0.5 to about 5 and wherein said hydrogenation catalyst comprises a Group VIII metal on an inorganic oxide support and said isomerization catalyst comprises a Group VIII metal on an inorganic oxide support having acidic sites.

38. A process as set forth in claim 37, wherein said Group VIII metal of said hydrogenation catalyst comprises platinum.

39. A process as set forth in claim 38, wherein said Group VIII metal of said isomerization catalyst comprises platinum.

40. A process as set forth in claim 39, wherein said inorganic oxide support of said isomerization catalyst is chlorided alumina or a zeolite.

41. A process as set forth in claim 1, wherein the separating step is carried out in a catalytic distillation reactor and wherein said alkylation step is carried out on the benzene-containing lighter fraction in catalytic distillation reactor.

42. A process as set forth in claim 41, wherein the hydrogenation zone and the isomerization zone are also located in said catalytic distillation reactor.

43. A process as set forth in claim 42, wherein said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

44. A process as set forth in claim 42, wherein said alkylation conditions include a temperature which falls within a range from about 350° F. to about 450° F., a pressure which falls within a range from about 150 psig to about 300 psig and a LHSV (liquid hourly space velocity) which falls within a range from about 1 to about 3.

45. A process as set forth in claim 44, wherein said hydrogenation conditions include a temperature which falls within a range from about 300° F. to about 500° F., a pressure which falls within a range from about 200 psig to about 500 psig, a hydrogen to hydrocarbon molar ratio which falls within a range from about 0.5 to about 5 and a LHSV which falls within a range from about 1 to about 5 and wherein said hydrogenation catalyst comprises a Group VIII metal on an inorganic oxide support.

46. A process as set forth in claim 45, wherein said Group VIII metal of said hydrogenation catalyst comprises platinum.

47. A process as set forth in claim 45, wherein said isomerization conditions include a temperature which falls within a range from about 300° F. to about 500° F., a pressure which falls within a range from about 200 psig to about 500 psig and a LHSV which falls within a range from about 1 to about 5 and wherein said isomerization catalyst comprises a Group VIII metal on an inorganic oxide support having acidic sites.

48. A process as set forth in claim 47, wherein said Group VIII metal of said isomerization catalyst comprises platinum.

49. A process as set forth in claim 48, wherein said inorganic oxide support of said isomerization catalyst is chlorided alumina or a zeolite.

50. A process as set forth in claim 43, wherein said hydrogenation conditions include a temperature which falls within a range from about 300° F. to about 500° F., a pressure which falls within a range from about 200 psig to about 500 psig, a hydrogen to hydrocarbon molar ratio which falls within a range from about 0.5 to about 5 and a LHSV which falls within a range from about 1 to about 5 and wherein said hydrogenation catalyst comprises a Group VIII metal on an inorganic oxide support.

51. A process as set forth in claim 50, wherein said Group VIII metal of said hydrogenation catalyst comprises platinum.

52. A process as set forth in claim 49, wherein said isomerization conditions include a temperature which falls within a range from about 300° F. to about 500° F., a pressure which falls within a range from about 200 psig to about 500 psig and a LHSV which falls within a range from about 1 to about 5 and wherein said isomerization catalyst comprises a Group VIII metal on an inorganic oxide support having acidic sites.

53. A process as set forth in claim 52, wherein said Group VIII metal of said isomerization catalyst comprises platinum.

54. A process as set forth in claim 53, wherein said inorganic oxide support of said isomerization catalyst is chlorided alumina or a zeolite.

55. A process as set forth in claim 54, wherein said refinery stream is obtained by the step of:

separating a $C_5+$ reformate having octane numbers of at least selected values into a light reformate fraction boiling below about 200° F. and a heavy reformate fraction boiling above about 200° F. and further including the step of:

combining said substantially benzene-free gasoline blending stock with said heavy reformate fraction to form a full boiling range gasoline having octane numbers of at least about said selected values.

56. A process as set forth in claim 1, wherein said hydrogenation zone and said isomerization zone are combined within a single reactor.

57. A process as set forth in claim 56, wherein the hydrogenation zone and the isomerization zone are in said reactor.

58. A process as set forth in claim 57, wherein said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

59. A process as set forth in claim 58, wherein said hydrogenation conditions and said isomerization conditions each include a temperature which falls within a range from about 300° F. to about 500° F., a pressure which falls within a range from about 200 psig to about 500 psig and a LHSV which falls within a range from about 1 to about 5, wherein said hydrogenation conditions also include a hydrogen to hydrocarbon molar ratio of from about 0.5 to about 5 and wherein said hydrogenation catalyst comprises a Group VIII metal on an inorganic oxide support and wherein said isomerization catalyst comprises a Group VIII metal on an inorganic oxide support having acidic sites.

60. A process as set forth in claim 59, wherein said Group VIII metal of said hydrogenation catalyst comprises platinum.

61. A process as set forth in claim 60, wherein said Group VIII metal of said isomerization catalyst comprises platinum.

62. A process as set forth in claim 61, wherein said inorganic oxide support of said isomerization catalyst is chlorided alumina or a zeolite.

63. A process as set forth in claim 56, said alkylation conditions include a temperature which falls within a range from about 300° F. to about 500° F., a pressure which falls within a range from about 100 psig to about 500 psig and a LHSV (liquid hourly space velocity) which falls within a range from about 0.5 to about 5.

64. A process as set forth in claim 63, wherein said hydrogenation conditions and said isomerization conditions each include a temperature which falls within a range from about 300° F. to about 500° F., a pressure which falls within a range from about 200 psig to about 500 psig and a LHSV which falls within a range from about 1 to about 5, wherein said hydrogenation conditions also include a hydrogen to hydrocarbon molar ratio of from about 0.5 to about 5 and wherein said hydrogenation catalyst comprises a Group VIII metal on an inorganic oxide support and wherein said isomerization catalyst comprises a Group VIII metal on an inorganic oxide support having acidic sites.

65. A process as set forth in claim 64, wherein said Group VIII metal of said hydrogenation catalyst comprises platinum.

66. A process as set forth in claim 65, wherein said Group VIII metal of said isomerization catalyst comprises platinum.

67. A process as set forth in claim 66, wherein said inorganic oxide support of said isomerization catalyst is chlorided alumina or a zeolite.

* * * * *